US006845933B2

(12) United States Patent
Stemper

(10) Patent No.: US 6,845,933 B2
(45) Date of Patent: Jan. 25, 2005

(54) IMPELLER BAR RETAINING WEDGE ASSEMBLY AND ROTOR EMPLOYING THE SAME

(75) Inventor: Michael P. Stemper, Marion, IA (US)

(73) Assignee: Cedarapids, Inc., Cedar Rapids, IA (US)

( * ) Notice: Subject to any disclaimer, the term of this patent is extended or adjusted under 35 U.S.C. 154(b) by 0 days.

(21) Appl. No.: 10/156,474

(22) Filed: May 28, 2002

(65) Prior Publication Data

US 2003/0127550 A1 Jul. 10, 2003

Related U.S. Application Data

(60) Provisional application No. 60/347,198, filed on Jan. 9, 2002.

(51) Int. Cl.[7] ..... B02C 13/26

(52) U.S. Cl. ..... 241/189.1; 29/428; 241/294

(58) Field of Search ..... 241/189.1, 294, 241/191; 29/428, 525.02, 525.11

(56) References Cited

U.S. PATENT DOCUMENTS

| | | | | |
|---|---|---|---|---|
| 2,258,075 A | | 10/1941 | Symons | 83/46 |
| 2,877,956 A | | 3/1959 | Sackett | 241/189 |
| 2,962,233 A | | 11/1960 | Chryst | 241/239 |
| 3,186,651 A | | 6/1965 | Briolini | 241/186 |
| 4,017,035 A | | 4/1977 | Stuttmann | 241/189 |
| 4,039,151 A | | 8/1977 | Coxhill | 241/189 |
| 4,577,806 A | | 3/1986 | Terrenzio | 241/275 |
| 4,821,970 A | * | 4/1989 | Puetz | 241/192 |
| 4,896,838 A | | 1/1990 | Vendelin | 241/275 |
| 4,923,131 A | | 5/1990 | Rossouw | 241/275 |
| 5,046,670 A | | 9/1991 | Leikin | 241/194 |
| 5,497,951 A | | 3/1996 | Watajima | 241/300 |

* cited by examiner

*Primary Examiner*—Mark Rosenbaum
(74) *Attorney, Agent, or Firm*—Marshall, Gerstein & Borun LLP

(57) ABSTRACT

A retaining wedge assembly for securing an impeller bar to the rotor of a horizontal shaft impact crusher comprises a recess defined in the rotor and sized to receive the impeller bar. The recess includes a first seat shaped to engage a first portion of the impeller bar and a second seat. A retaining wedge includes a first portion adapted to engage a second portion of the impeller bar, and a second portion sized to engage the second seat. A countersunk slot on the second seat receives the retaining wedge, which in turn cooperates to secure the impeller bar in the recess. Guide flanges may be provided for limiting axial movement of the retaining wedge. Thus, the impeller bar may be supported in the recess prior to start-up of the horizontal shaft impact crusher.

27 Claims, 6 Drawing Sheets

FIG.1
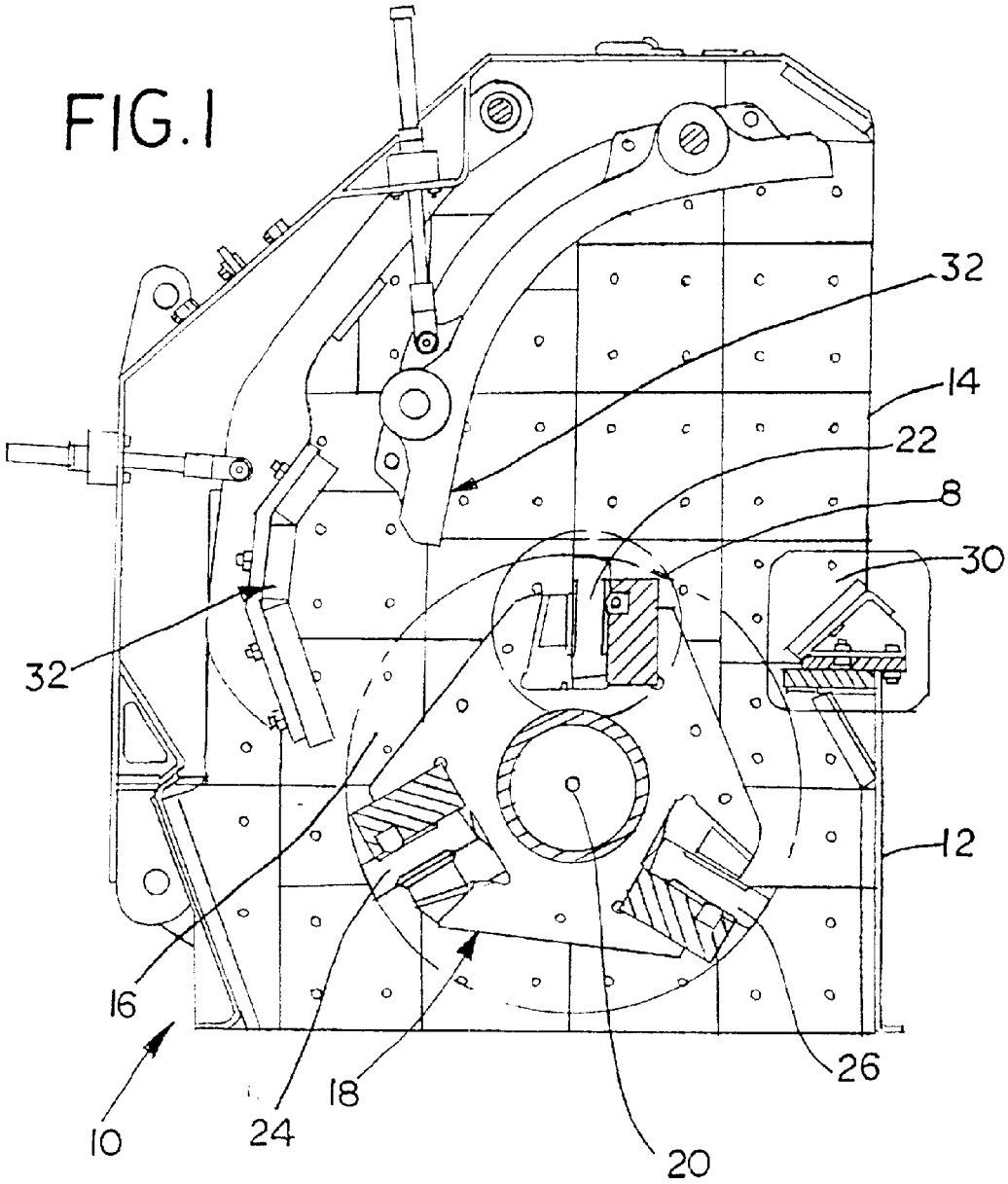
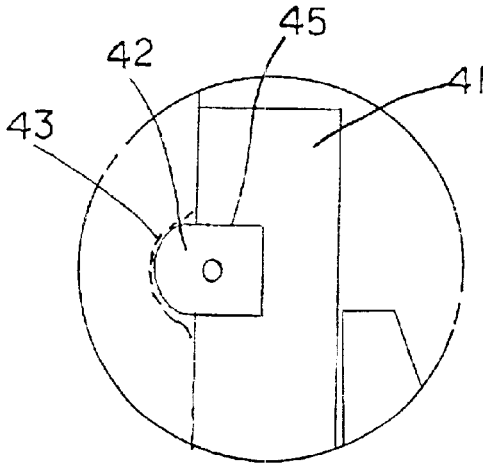
FIG.8

IMPELLER BAR RETAINING WEDGE ASSEMBLY AND ROTOR EMPLOYING THE SAME

RELATED APPLICATIONS

This application claims priority from U.S. Provisional Application Ser. No. 60/347,198, filed Jan. 9, 2002.

FIELD OF THE INVENTION

The invention relates generally to impact crushers, and, more particularly, to an apparatus for securing an impeller bar to the rotor of a horizontal shaft impact crusher.

BACKGROUND OF THE INVENTION

Horizontal shaft impact crushers are commonly employed to pulverize many different types of materials including, by way of example rather than limitation, asphalt, concrete, and rock. Such crushers typically include a frame, a crushing cavity, and a rotor disposed within the cavity and supporting a number of impeller bars. Typically, the rotor includes a plurality of discs that are axially spaced relative to the rotational axis of the rotor, with each of the discs having a number of recesses in which the impeller bars are mounted. The rotor is typically driven by an external drive mechanism.

The rotor and the attached impeller bars are generally surrounded by a number of breaker plates. The frame includes a feed opening to permit the material to be fed into the crushing cavity, such that the material comes into contact with the impeller bars of the rotating rotor. The impeller bars repeatedly throw the material against the breaker plate(s), thereby breaking the material into smaller pieces.

As is known, the impeller bars must be adjusted periodically to account for wear. Eventually, the impeller bars must be replaced altogether. Thus, there must a mechanism to provide for the easy adjustment and/or the eventual removal of the impeller bars from the rotor.

Many impeller bars are secured to the rotor using a wedge assembly that secures the impeller bars within the recess. The wedge is typically oriented such that the tendency of the impeller bar to slide radially away from the axis of the rotor is resisted by the wedge bearing against a portion of the recess. The wedge and the recess are shaped such that the gripping forces of the wedge(s) against the impeller bar actually increase as the impeller bar slides moves (e.g., slides radially outwardly). Thus, the impeller bar(s) actually gets tighter after the crusher has been started.

However, the impeller bars and the wedges might not be fully secured until after start up of the crusher. Thus, it is desirable to ensure that the wedges and impeller bars are at least temporarily secured prior to start up of the crusher.

BRIEF DESCRIPTION OF THE DRAWINGS

FIG. 1 is a schematic elevational view of a horizontal shaft impact crusher;

FIG. 8 is an enlarged fragmentary elevational view taken at the circumscribed area of FIG. 1.

DETAILED DESCRIPTION OF THE PREFERRED EMBODIMENT

Figure 2:
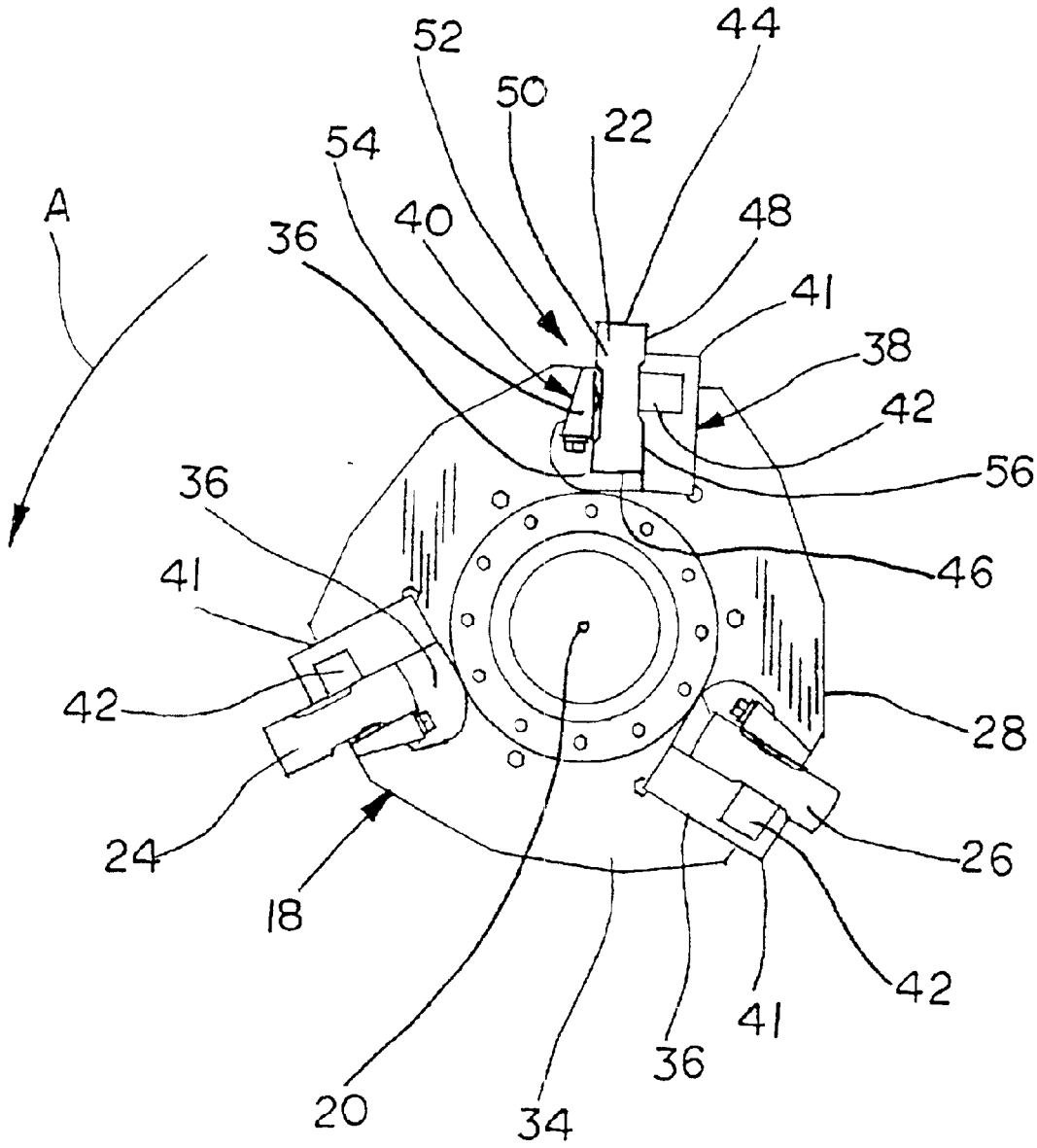
FIG. 2 is a schematic illustration of a rotor assembly for use on the horizontal shaft impact crusher and having the three impeller bars secured by a retaining wedge assembly constructed in accordance with the teachings of the present invention.

The embodiment(s) described herein are not intended to be exhaustive or to limit the scope of the invention to the precise form or forms disclosed. The following embodiment (s) have been chosen and described in order to best explain the principles of the invention and to enable others skilled in the art to follow its teachings.

Referring now to the drawings, FIG. 1 illustrates a horizontal shaft impact crusher 10 having a frame 12 and a housing 14 enclosing an internal crushing cavity 16. A rotor 18 is supported on bearings (not shown) such that the rotor 18 rotates about a central axis 20 in a direction generally indicated by the reference arrow A. The rotor 18 includes a plurality of hammers or impeller bars 22, 24 and 26. The impeller bars 22, 24, 26 may be of conventional construction. Each of the impeller bars 22, 24, 26 are disposed generally adjacent an outer periphery 28 of the rotor 18. The housing 14 is provided with a feed opening 30, which permits aggregate material (not shown) to be fed into the cavity 16 in a suitable manner as would be known.

As is known, the aggregate material entering the crushing cavity 16 through the feed opening 30 comes into contact with the impeller bars 22, 24, 26, such that the impeller bars strike the aggregate material and propel the aggregate material toward one or more breaker plates 32. The aggregate material is thus crushed into smaller sizes in response to striking the breaker plates 32. As would be known, a conventional drive mechanism (not shown) and a gear train (not shown) are operatively coupled to the rotor 18 in order to rotate the rotor 18 about its central axis 20.

Figure 3:
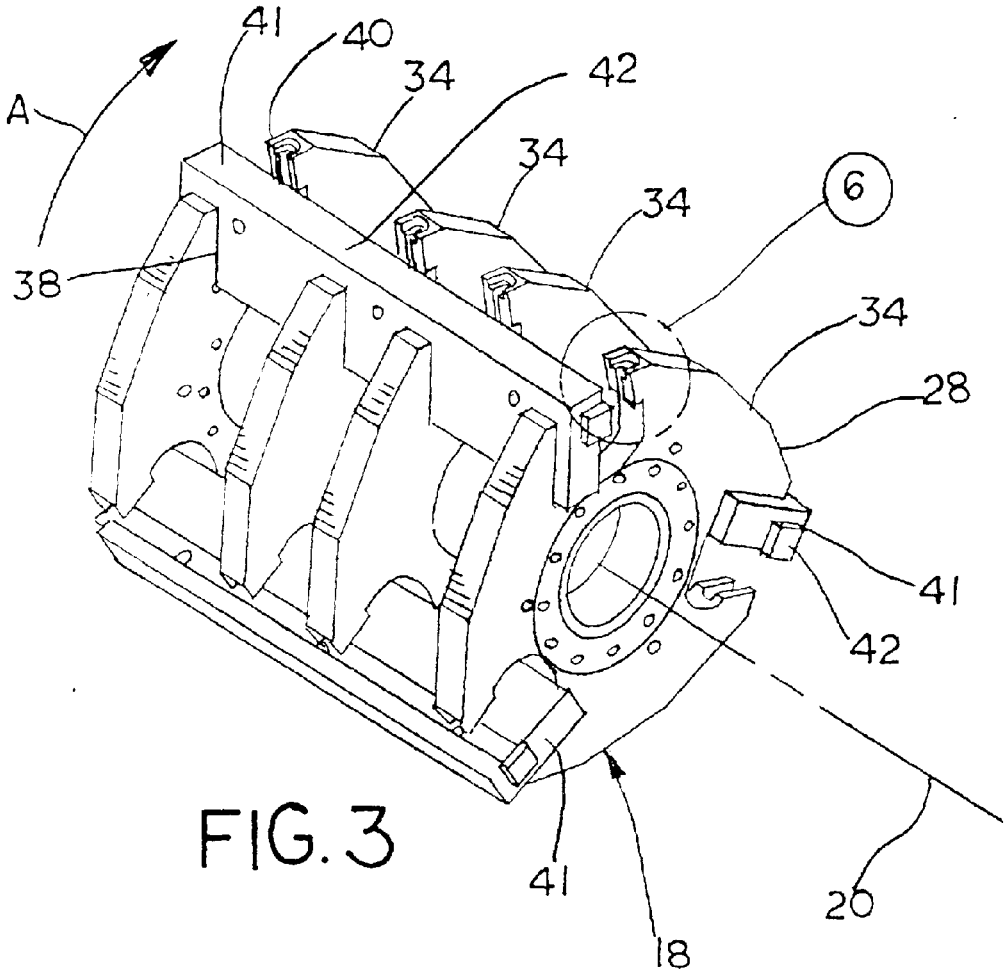
FIG. 3 is a perspective view of the rotor.

Referring now to FIGS. 2 and 3, the rotor 18 is typically constructed from a plurality of discs 34, with four such discs 34 being shown in FIG. 3. Typically, the discs 34 are spaced apart along the central axis 20 of the rotor 18. It will be understood that additional or fewer discs 34 may be employed. It will also be understood that the rotor 18 may be constructed using any other suitable construction.

Each disc 34 will preferably have a plurality of recesses 36, with the recesses 36 being spaced about the periphery 28 of the rotor 18. In the rotor 18 shown in FIG. 2, each disc 34 includes three such recesses 36, with the recesses spaced apart generally equal distances about the periphery of the rotor 18, such that the rotor 18 accommodates the three impeller bars 22, 24, 26. Additional or fewer recesses 36 may be provided, in order to accommodate additional or fewer impeller bars as would be known in the art. It will be understood that only a single one of the impeller bars 22 disposed in a corresponding one of the recesses 36 will be described herein in detail. The remaining impeller bars 24, 26 may be suitably secured in their corresponding recesses 36 as required in a similar manner.

As shown in each of FIGS. 2 and 3, each recess 36 includes a seat 38 (to the right of the impeller bar 22 when viewing the Figs.) and a seat 40 (to the left of the impeller bar 22 when viewing the Figs.). The seat 38 may include a backer bar 41 (FIGS. 1, 2, 3 and 8). The backer bar 41 will preferably be constructed of a material that is softer than the disc 34, such that the backer bar 41 (which may be removable or which may be welded in place), will wear faster than the seat 38, thus extending the service life of the seat 38 and hence the disc 34. Alternatively, the backer bar 41 may be eliminated. For the sake of brevity, the following discussion will treat the seat 38 as if the seat 38 is defined on the disc 34.

The impeller bar 22 includes a radially outer portion 44, a radially inner portion 46, and a pair of opposed faces 48, 50. A retaining assembly generally designated as 52 (FIG. 2) assembled in accordance with the teachings of the present invention is provided. In the disclosed example, the retaining assembly 52 includes a wedge 54. Alternatively, the retaining assembly 52 could include another suitable shape that is arranged to interact with the shape of the recess 36 and the seats 38, 40 to apply a suitable force to the impeller bar 22.

Referring now to FIG. 8, the backer bar 41 preferably includes an insert 42. The insert 42 is sized and shaped to engage a notch 43 on the face 48 of the impeller bar 22. The insert 42 functions as a key, and may be permanently secured to a seat 45 in the backer bar 41 or, as an alternative, the insert 42 may be removable.

In accordance with the disclosed example, the wedge 54 is disposed between the seat 40 and the face 50 of the impeller bar 22, while the face 48 of the impeller bar 22 abuts a face 56 of the backer bar 41. Alternatively, it will be understood that the wedge 54 may be positioned on the opposite side of the impeller bar 22 so as to contact the face 48. In such an alternate form, the seat 40 would preferably include a suitable insert for the purposes described above.

Figure 4:
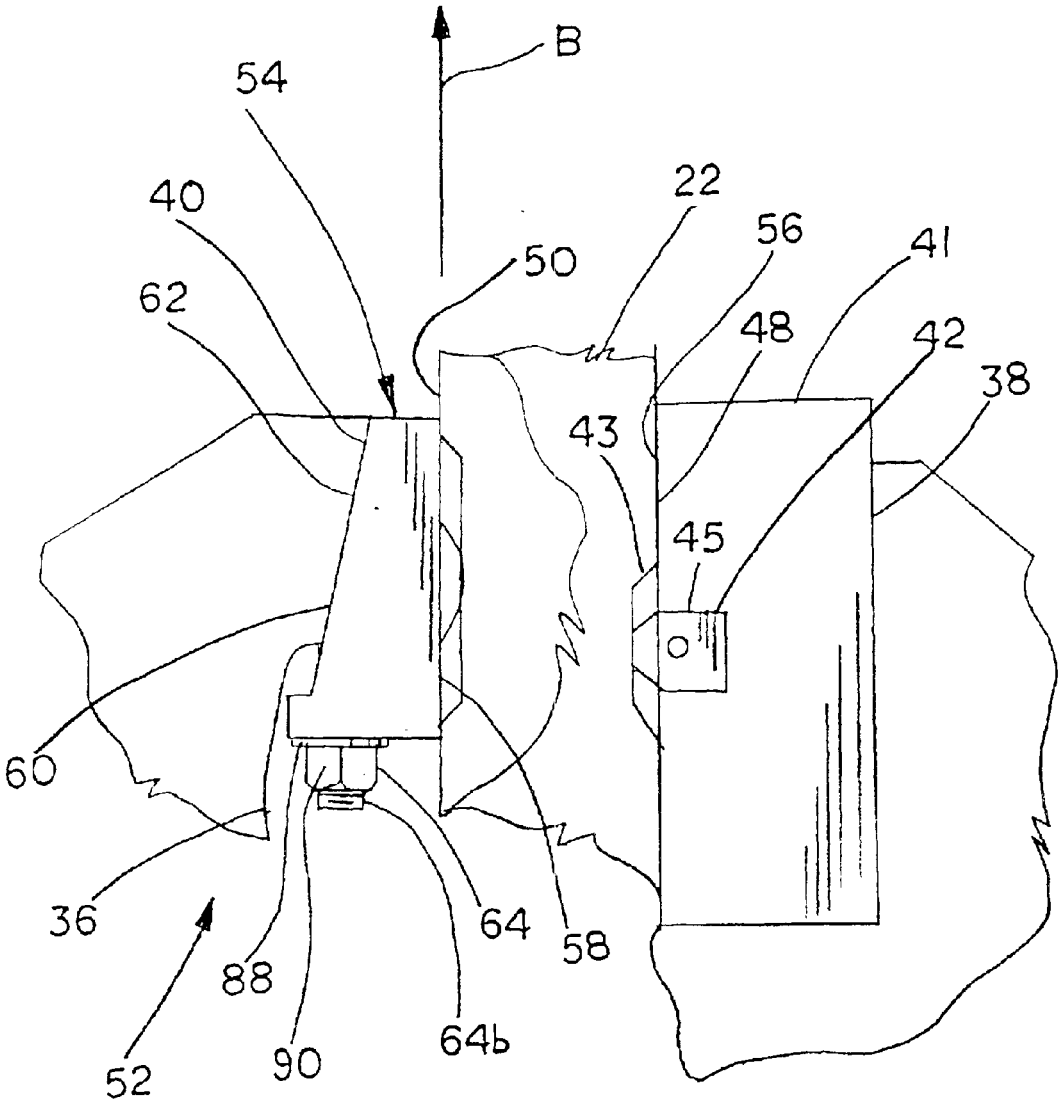
FIG. 4 is an enlarged fragmentary elevational view of the retaining wedge assembly in accordance with the teachings of the present invention.
Figure 5:
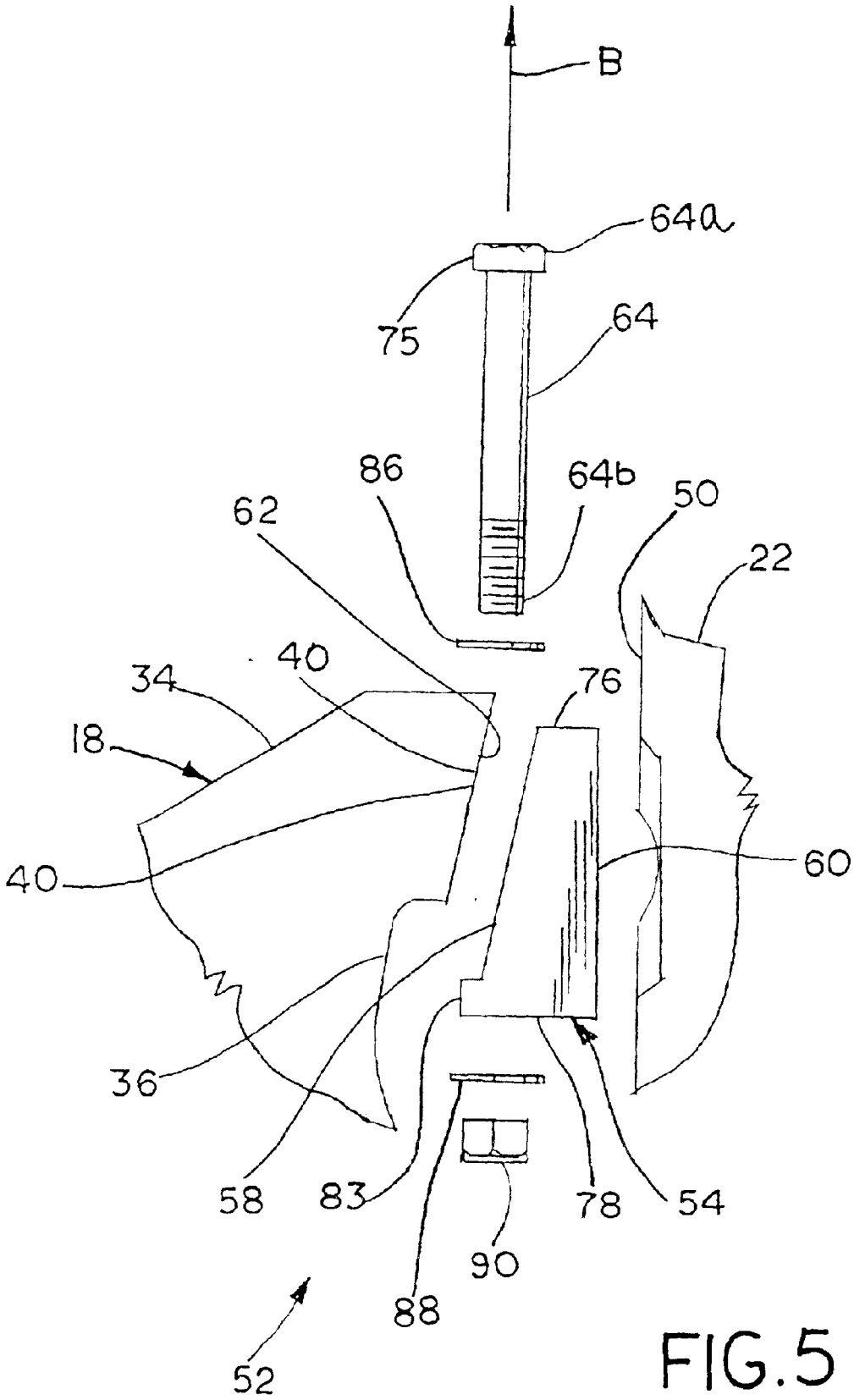
FIG. 5 is an enlarged fragmentary exploded view thereof.

Referring now to FIGS. 4 and 5, the wedge 54 includes a pair of faces 58, 60. It will be noted that in accordance with the disclosed embodiment, the seat 40 includes an angled face 62 which is oriented at an angle relative to the face 50 of the impeller bar 22. The face 58 of the wedge 54 is angled with respect to the face 60, such that the face 58 may be positioned to mate with/abut the angled face 62, with the face 60 of the wedge 54 oriented parallel to the face 50 of the impeller bar 22. Preferably, the face 50 of the impeller bar 22 and the face 60 of the wedge 54 may be oriented parallel to the line B extending radially outward from the central axis 20. An attachment bolt 64 is provided to secure the wedge 54 to the seat 40 in a manner to be described in greater detail below.

Figure 6:
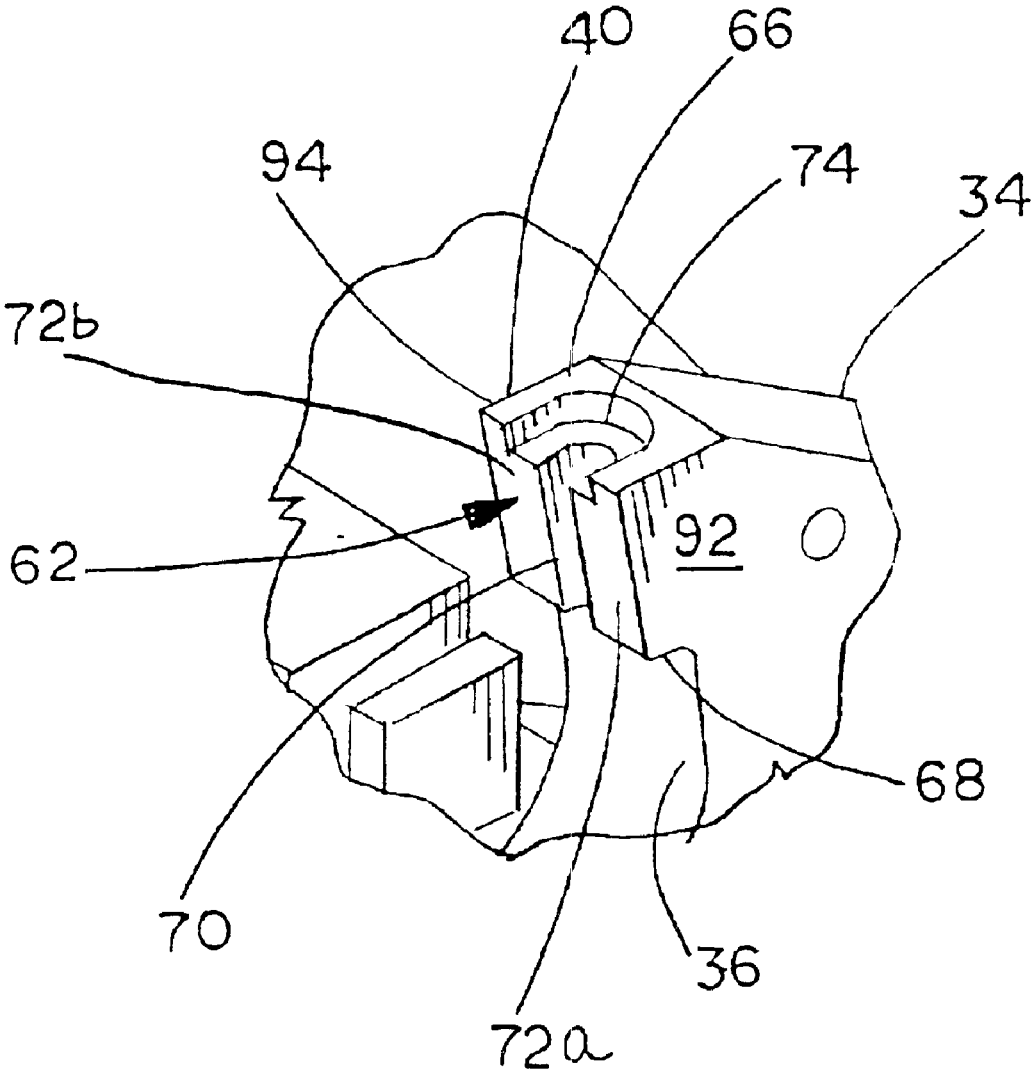
FIG. 6 is an enlarged fragmentary view in perspective of a seat for supporting the wedge and having a counterbored slot.

Referring now to FIG. 6, an enlarged fragmentary view in perspective of the seat 40 is shown therein. The seat 40 includes an upper end 66 and a lower end 68. For ease of reference, the terms "upper" and "lower" refer to the device when oriented as shown in FIGS. 4–7. It will be understood that the term "upper" relates to a radially outward direction relative to the central axis 20 of the rotor 18, while the term "lower" refers to a radially inward direction relative to the central axis 20.

A slot 70 extends between the upper and lower ends 66, 68, such that the angled face 62 of the seat 40 is divided into a pair of surfaces 72*a* and 72*b*. In the example shown the surfaces 72*a* and 72*b* are separated by the slot 70. The upper end 66 of the seat 40 is provided with a counterbore 74. The counterbore 74 is sized to receive an outer end 64*a* (FIG. 5) of the attachment bolt 64 (e.g., the counterbore 74 is sized to receive all or a portion of a head 75 shown in FIG. 5 at the outer end 64*a* of the attachment bolt 64). The bolt head 75 may thus be substantially protected from undue wear by virtue of being substantially unexposed to excessive direct contact with the aggregate material being crushed.

Figure 7:
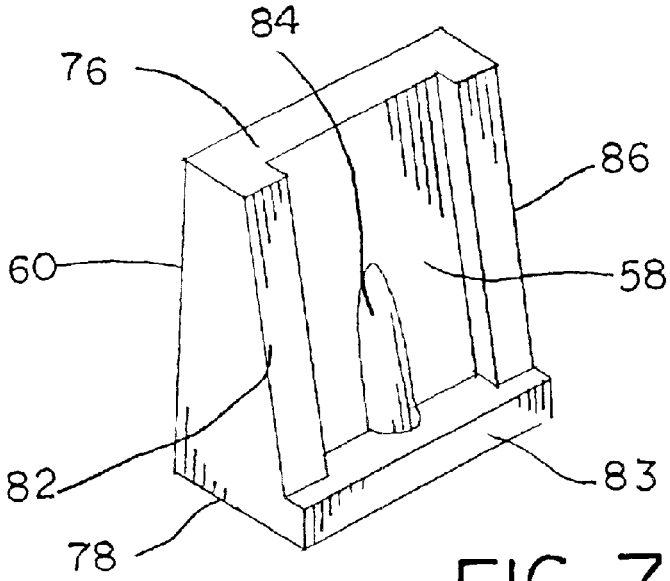
FIG. 7 is an enlarged fragmentary view in perspective of a wedge for mating with the seat of FIG. 6.

Referring now to FIG. 7, the wedge 54 includes a top 76, a bottom 78. In the preferred example, the wedge 54 includes a pair of side flanges 80, 82. Alternatively, the side flanges 80, 82 may be omitted. The bottom 78 may include a bottom flange 83. The wedge 54 also includes an aperture 84 that is sized to receive a shaft of the attachment bolt 64, such that an inner end 64*b* (FIGS. 4 and 5) and of the attachment bolt may extend below the bottom 78 of the wedge 54. In the disclosed embodiment, the aperture 84 extends through the angled face 58, as well as through a portion of the bottom flange 83.

Referring again to FIG. 5, the wedge 54 may be attached to the seat 40 using the attachment bolt 64 oriented as shown. Preferably, a pair of washers 86, 88 are provided, with the washer 86 sized to be received in the counterbore 74, and with the washer 88 sized to abut the bottom 78 of the wedge 54 such that a threaded nut 90 threaded onto the threaded shaft of the attachment bolt 64 bears against the washer 88, thus applying a force to the bottom 70 of the wedge 54.

In operation, the impeller bar 22 is attached to the rotor 18 by placing the impeller bar 22 in the recess 36 of the disc 34 (and through an aligned recess in the next adjacent disc or discs), such that the impeller bar extends generally parallel to the central axis 20 of the rotor 18. As would be known, the face 48 of the impeller bar 22 is seated against or abuts the seat 38 (e.g., the face 48 of the impeller bar abuts the face 56 of the insert 42 should the seat 38 be provided with such an insert).

The retaining assembly 52 may be assembled by positioning the attachment bolt 64 substantially as shown in FIG. 5, and positioning the inner end 64*b* of the attachment bolt 64 through the slot 70 of the seat 40. The shaft of the attachment bolt 64 will extend through the aperture 84 in the angled face 58 of the wedge 54. Again, suitable washers and or lock washers may be provided as desired.

Referring now to FIG. 4, as the threaded nut 90 is threaded onto the attachment bolt 64, the wedge 54 will be shifted in a radially outward direction (upward when viewing FIG. 4). By virtue of the angle on the seat 40 and the angled face 60 of the wedge 54, as the attachment bolt 64 is tightened, such as by tightening the threaded nut 90, the wedge 54 will be urged radially outward and generally toward the right when viewing FIG. 4. Thus, the face 58 of the wedge 54 will apply a progressively greater force against the face 50 of the impeller bar 22 (e.g., the angled faces 60 and 62, effectively cause the recess 36 to narrow with distance away from the central axis 20 of the rotor 18). Stated another away, the seats 38, 40 are separated by a first distance when measured generally adjacent to a lower portion of the recess 36, and the seats 38, 40 are separated be a second and lesser distance when measured generally adjacent to an upper portion of the recess 36. As also shown in FIG. 4, the bottom flange 83 on the wedge 54 may be sized to abut a ledge 85 at the lower end 68 of the seat 40.

Referring now to FIGS. 6 and 7, the side flanges 80, 82 of the wedge 54 are sized to abut corresponding side edges 92, 94 (FIG. 6) of the seat 40. In the disclosed example the side edges 92, 94 are defined at least in part by corresponding side edge portions of the disc 34. Consequently, should the impeller bar 22 or the wedge 54 drift in a direction generally parallel to the central axis 20 of the rotor 18 (such drift being generally referred to throughout as "axial drift"), the side flanges 80, 82 will prevent the wedge 54 from moving past the seat 40. In the disclosed example, the side flanges 80, 82 will permit some limited axial drift, subject to the distance between the side flanges 80, 82 minus the distance between the side edges 92, 94.

As alternatives, the seat 40 and/or the wedge 78 may be provided with a suitably sized bore or a slot. The bore or slot preferably is suitably sized to permit movement of the wedge 54 in the outward direction and/or in the direction toward and away from the appropriate face of the impeller bar 22.

During operation of the horizontal shaft impact crusher 10, the impeller bars 22, 24, 26 will tend to migrate radially outwardly, especially immediately after installation. By virtue of the retaining assembly 52 including the wedge 54, this outward migration tends to increase the grip of the wedge 54 on the impeller bars. In at least one possible mode of operation, the impeller bars 22, 24, 26 and the wedges 54 need not be fully tightened prior to start up of the crusher 10. Instead, operation of the crusher 10 effectively secures the impeller bars by letting the impeller bars tighten themselves.

The retaining assembly 52 according to the disclosed example permits the operator of the crusher 10 to apply a preload to the joint between the wedge 54 and the appropriate impeller bar 22, 24 or 26. However, it is known that the impeller bars are subject to axial drift, which, even if contained by the rotor itself, may cause a mis-alignment of the wedges 54. It therefore is desirable to minimize and/or eliminate axial drift of the wedges 54. One manner of accomplishing this goal is to provide for the application of a preload to the wedge joint. However, it may be desirable to provide for the application of a preload without developing moments on the wedge, as a moment on the wedge 54 may hinder the application of the preload force. A retaining assembly constructed according to the disclosed example situates the attachment bolt 64 such that the attachment bolt 64 passes through or near to the plane separating the face 50 of the impeller bar 22 and the face 58 of the wedge 54. This orientation helps to reduce and/or eliminate moments applied to the wedge 54 when applying the preload.

Preferably, the wedge 54 is constructed of a material that is softer (i.e., has a lower hardness) than the material that forms the impeller bars 22, 24, 26 and the disc 34. Consequently, the wedge 54 is the component that will receive the most abuse. This is desirable in that the wedge 54 is easily replaceable, and can be replaced without disassembly of the rotor 18 and without removal of the impeller bars.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

What is claimed:

1. A retaining wedge assembly for securing an impeller bar to the rotor of a horizontal shaft impact crusher, the retaining wedge assembly comprising:

a recess defined in the rotor, the recess sized to receive the impeller bar and including a first seat and a second seat, the first seat shaped to receive a first portion of the impeller bar, the second seat including an aperture;

a retaining wedge, the retaining wedge having a first face adapted to engage a second portion of the impeller bar, and a second face sized to engage the second seat, the retaining wedge further adapted to receive an attachment bolt; and the attachment bolt extending through the retaining wedge, the attachment bolt arranged to drive the wedge along the second seat;

whereby upon placement of the impeller bar in the recess and upon tightening the attachment bolt the wedge cooperates with the first seat and the and second seat to secure the impeller bar in the recess.

2. The assembly of claim 1, wherein the aperture of the second seat comprises a slot, the slot including a countersunk portion sized to receive an outer end of the attachment bolt.

3. The assembly of claim 1, wherein the first seat and the second seat are shaped to converge toward each other such that a distance between the first seat and the second seat decreases away from a central axis of the rotor.

4. The assembly of claim 1, wherein the aperture of the second seat comprises a countersunk slot, the slot adapted to permit the attachment bolt to extend at an angle relative to an angled face of the second seat.

5. The assembly of claim 1, wherein the aperture of the second seat of the recess comprises a countersunk slot, and wherein the slot and the bore cooperate to permit the attachment bolt to be oriented generally parallel to the first face of the wedge.

6. The assembly of claim 1, wherein the wedge includes a pair of spaced apart side flanges, the side flanges cooperating with the second seat to limit axial movement of the wedge.

7. The assembly of claim 1, wherein the wedge is constructed of a material having a hardness less than the hardness of the rotor.

8. An assembly for mounting to a frame of a horizontal shaft impact crusher, the assembly comprising:

a disc adapted for mounting to the frame for rotation about a central axis of rotation, the disc including a recess disposed adjacent an outer peripheral portion of the disc;

an impeller bar extending generally parallel to the axis of rotation, the impeller bar received in the recess of the disc, the impeller bar having a first face and a second face;

the recess including a first seat and a second seat, the first seat of the recess engaging a first face of the impeller bar, the second seat of the recess adapted to receive an outer portion of an attachment bolt; and a retaining wedge, the retaining wedge having a first face adapted to engage the second face of the impeller bar, and a second face shaped to engage the second seat of the recess, the retaining wedge further adapted to receive an inner portion of the attachment bolt, whereby the retaining wedge cooperates with the first seat and the second seat to maintain the impeller bar in the recess.

9. The assembly of claim 8, wherein the retaining wedge includes a pair of spaced apart side flanges, the side flanges arranged to contact at least a portion of the disc to thereby limit axial movement of the impeller bar.

10. The assembly of claim 8, wherein the second seat comprises a countersunk slot sized to receive the outer portion of the attachment bolt.

11. The assembly of claim 8, wherein the first seat and the second seat are shaped to converge toward each other such that a distance between the first seat and the second seat decreases with distance away from a central axis of the rotor.

12. The assembly of claim 8, wherein the second seat is sized and shaped to orient the attachment bolt at an angle relative to a face of the second seat.

13. The assembly of claim 8, the second seat comprising a countersunk slot, the retaining wedge including a bore sized to receive the inner portion of the attachment bolt, and wherein the slot and the bore cooperate to orient the attachment bolt to generally parallel to the first face of the retaining wedge.

14. An assembly for mounting an impeller bar to a horizontal shaft impact crusher, the assembly comprising:

a rotor;

a recess defined in a peripheral portion of the rotor, the recess sized to receive the impeller bar, the recess including a first seat and a second seat, the first seat adapted to receive a first face of the impeller bar, the second seat arranged to receive an outer portion of an attachment bolt;

a retaining wedge, the retaining wedge having a first face adapted to engage the second face of the impeller bar, and a second face shaped to engage the second seat of the recess, the retaining wedge further adapted to receive an inner portion of the attachment bolt, whereby the retaining wedge cooperates with the first seat and the second seat to maintain the impeller bar in the recess.

15. The assembly of claim 14, wherein the second seat and the second face of the retaining wedge are disposed at an angle relative to the first face of the retaining wedge.

16. The assembly of claim 14, wherein the retaining wedge includes a pair of spaced apart side flanges, the side flanges cooperating with a portion of the rotor to thereby limit axial movement of the retaining wedge.

17. The assembly of claim 14, wherein the second seat comprises a countersunk slot sized to receive the outer portion of the attachment bolt.

18. The assembly of claim 14, wherein the first seat and the second seat are shaped to converge toward each other such that a distance between the first seat and the second seat decreases with distance away from a central axis of the rotor.

19. The assembly of claim 17, wherein the second seat is sized and shaped to permit orientation of the attachment bolt at an angle relative to a face of the second seat.

20. The assembly of claim 14, wherein the second seat includes a countersunk slot, and wherein the retaining wedge includes a bore sized to receive the inner portion of the attachment bolt, the second face of the retaining wedge and the second seat disposed at an angle relative to the first face of the retaining wedge, and wherein the slot and the bore cooperate to orient the attachment bolt generally parallel to the first face of the retaining wedge.

21. The assembly of claim 14, wherein the retaining wedge and the rotor are adapted for abutting contact in response to axial movement of the retaining wedge thereby permitting only limited axial movement of the retaining wedge.

22. The assembly of claim 14, wherein the retaining wedge is constructed of a material having a hardness less than a hardness of the rotor.

23. A method of securing an impeller bar to the rotor of a horizontal shaft impact crusher, the method comprising the steps of:

providing a recess defined in the rotor, the recess sized to receive the impeller bar;

forming a first seat and a second seat on the recess;

placing an impeller bar in the recess with a first surface of the impeller bar engaging the first seat of the recess;

providing a retaining wedge;

placing the retaining wedge in the second seat with a first face of the retaining wedge engaging a second surface of the impeller bar and with a second face of the retaining wedge engaging the second seat of the recess;

providing a countersunk slot in the second seat;

placing an attachment bolt in the countersunk slot, an inner portion of the attachment bolt engaging an inner portion of the retaining wedge; and applying a preload to the attachment bolt to secure the impeller bar.

24. The method of claim 23, including the step of providing a pair of spaced apart flanges on the retaining wedge.

25. The method of claim 23, wherein the retaining wedge is constructed of a material having a hardness less than a hardness of the impeller bar and a hardness of the rotor.

26. The method of claim 23, including the step of orienting the attachment bolt generally parallel to the second surface of the impeller bar.

27. The method of claim 26, the step of minimizing a distance between the attachment bolt and the second surface of the impeller bar.

* * * * *